US010148014B2

(12) United States Patent
Suh et al.

(10) Patent No.: US 10,148,014 B2
(45) Date of Patent: Dec. 4, 2018

(54) HIGHLY ISOLATED MONOPOLE ANTENNA SYSTEM

(71) Applicant: Intel Corporation, Santa Clara, CA (US)

(72) Inventors: Seong-Youp John Suh, Portland, OR (US); Tae Young Yang, Hillsboro, OR (US); Jose R. Camacho Perez, Guadalajara Jalisco (MX)

(73) Assignee: Intel Corporation, Santa Clara, CA (US)

( * ) Notice: Subject to any disclaimer, the term of this patent is extended or adjusted under 35 U.S.C. 154(b) by 193 days.

(21) Appl. No.: 15/275,290

(22) Filed: Sep. 23, 2016

(65) Prior Publication Data

US 2018/0090844 A1 Mar. 29, 2018

(51) Int. Cl.

| | |
|---|---|
| ***H01Q 1/24*** | (2006.01) |
| ***H01Q 9/26*** | (2006.01) |
| ***H01Q 1/36*** | (2006.01) |
| ***H01Q 1/48*** | (2006.01) |
| ***H01Q 13/10*** | (2006.01) |
| ***H01Q 1/52*** | (2006.01) |
| ***H01Q 9/42*** | (2006.01) |

(52) U.S. Cl.

CPC ..... *H01Q 9/26* (2013.01); *H01Q 1/241* (2013.01); *H01Q 1/243* (2013.01); *H01Q 1/36* (2013.01); *H01Q 1/48* (2013.01); *H01Q 1/525* (2013.01); *H01Q 9/42* (2013.01); *H01Q 13/10* (2013.01)

(58) Field of Classification Search

CPC ..... H01Q 1/24; H01Q 1/241; H01Q 1/242; H01Q 1/243; H01Q 1/52; H01Q 1/521; H01Q 1/523; H01Q 1/525; H01Q 21/28; H01Q 9/30–9/42; H01Q 13/10–13/18

See application file for complete search history.

(56) References Cited

U.S. PATENT DOCUMENTS

| | | | | |
|---|---|---|---|---|
| 6,424,309 | B1 * | 7/2002 | Johnston | H01Q 9/28 343/725 |
| 9,673,507 | B2 * | 6/2017 | Ramachandran | H01Q 1/243 |
| 2003/0210194 | A1 | 11/2003 | Gilmore | |
| 2007/0057846 | A1 | 3/2007 | Song et al. | |
| 2008/0238804 | A1 | 10/2008 | Suh et al. | |

(Continued)

OTHER PUBLICATIONS

Oh et al.,"Dual-Polarization Slot Antenna With High Cross-Polarization Discrimination for Indoor Small-Cell MIMO Systems", Antennas and Wireless Propagation Letters, IEEE, vol. 14, 2015, pp. 374-377.

(Continued)

*Primary Examiner* — Tho G Phan
*Assistant Examiner* — Patrick Holecek
(74) *Attorney, Agent, or Firm* — Schiff Hardin LLP

(57) ABSTRACT

Described herein are technologies that facilitate wireless communication with highly-isolated, dual-port antenna system. More particularly, an example antenna system that implements the technology includes a complementary pair of physically co-located antennas for signal transmission and/or reception. More particularly still, an example implementation of the disclosed technology is an antenna system that utilizes a monopole antenna symmetrically and physically co-located with a slot antenna in a shared antenna plane with a simple feed structure.

50 Claims, 5 Drawing Sheets

(56) References Cited

U.S. PATENT DOCUMENTS

| | | | | |
|---|---|---|---|---|
| 2010/0207829 | A1 | 8/2010 | Parsche | |
| 2010/0220034 | A1 | 9/2010 | Le et al. | |
| 2014/0327588 | A1* | 11/2014 | Tran | H01Q 21/24 343/727 |

OTHER PUBLICATIONS

Suh et al.,"In-Band Full-Duplex Complementary Antenna", U.S. Appl. No. 14/871,975, filed Sep. 30, 2015, 34 pages.
Search Report dated Oct. 3, 2017 for International Application No. PCT/US17/047579.

* cited by examiner

HIGHLY ISOLATED MONOPOLE ANTENNA SYSTEM

BACKGROUND

The next generation of wireless (e.g., cellular) communication technology standards improve over the previous generation's data throughput. It is expected that the so-called fifth generation (5G) wireless communication systems and networks will dramatically (e.g., about twice as much) increase the data throughput of the previous generation.

Existing wireless communication systems and networks (including current generations) employ duplexing. Namely, either frequency division duplex (FDD) or time division duplex (TDD) has been used for separate transmission and reception in different frequencies or at different times respectively. In FDD and TDD, transmitted signal does not interfere with received signal due to a separate use of frequency and time resources respectively. Therefore, twice the amount of frequency and/or time are used in current duplexing systems compared to in-band full-duplex (IBFD) systems. It seems possible to double data throughputs by simultaneous transmission and reception in the same frequency band at the same time.

In addition to in-band full-duplex (IBFD) operation, mobile-communications devices may also utilize multiple reception antennas and/or multiple transmission antennas. With multiple antennas in the same mobile-communications device, the device (i.e., node) transmits and/or receives simultaneously in the same, similar, or common frequency band. Because of this, one the biggest practical impediments of the use of multiple antennas in the same device is the presence of self-interference. That is, the interference caused by transmissions from or signals reception by the other antenna(s).

Many conventional approaches utilize two separate antennas that are spaced apart. The antenna pairs have a high isolation level (e.g., ~40 dB) with a relatively large separation and each antenna is dedicated to either signal transmission (TX) or reception (RX). While this dual-antenna approach eliminates a lossy and large circulator, it introduces new problems. The primary problems of this dual-antenna approach are space and complexity. Two separate and isolated antennas require more space because there are twice as many antennas, and those antennas must be physically spaced from each other sufficiently enough to reduce interference therebetween.

BRIEF DESCRIPTION OF THE DRAWINGS

The Detailed Description references the accompanying figures. In the figures, the left-most digit(s) of a reference number identifies the figure in which the reference number first appears. The same numbers are used throughout the drawings to reference like features and components.

DETAILED DESCRIPTION

Described herein are technologies to facilitate wireless communication with highly-isolated, dual-port antenna system. More particularly, an example antenna system that implements the technology includes a complementary pair of physically co-located antennas for signal transmission and/or reception. More particularly still, an example implementation of the disclosed technology is an antenna system that utilizes a monopole antenna symmetrically and physically co-located with a slot antenna in a shared antenna plane with a simple feed structure.

Such an antenna system is both compact and low-profile (relative to conventional approaches). For example, an example antenna system built in accordance with the technologies described herein may have an overall size of $0.6\lambda \times 0.7\lambda \times 0.1\lambda$ at the center frequency. The is $\lambda$ the wavelength of the center frequency.

An antenna system using the technologies described herein provides an extremely high (e.g., 60 dB or more) isolation between the ports and uni-directional radiation patterns with realized gain of 3-5 decibels-relative-to-isotropic (i.e., dBi) and wide half-power beamwidth (HPBW) of approximately 160 degrees. The reduced size and extremely high isolation of the described technology are likely to be attractive to those implementing the next generation (e.g., 5G) of wireless (e.g., cellular) communication standards.

Antenna systems utilizing the technologies described herein may be utilized in many wireless applications where a high transmission-transmission (Tx-Tx), reception-reception (Rx-Rx), and/or transmission-reception (Tx-Rx) isolation level is desired between co-located antennas. Examples of such applications include in-band full-duplex radio systems, radio range extenders, wireless local area network (i.e., Wi-Fi) channel bonding, Next Generation Wi-Fi, and multi-radio systems. In particular, the technology described herein solves major challenges (e.g., radio frequency (RF) front-end saturation or self-interference issues) of low Tx-Rx isolation.

Conventional approaches typically achieve antenna isolation by using a dual-polarized antenna pair by placing two identical antennas crossed each other. However, these conventional dual-polarized antennas have balance-feed structures that increase the complexity, cost, size, and weight of the total feed structure. For example, conventional approaches often use a hybrid or balun to feed the antennas. Unfortunately, hybrids or baluns introduce additional insertion loss in the transmission chain in addition to the increase in the complexity, cost, size and weight to the antenna assembly. Also, they also increase the noise figure in the reception chain. Even with a hybrid or balun solution of the conventional approaches, there is a significant challenge in achieving an isolation level greater than 60 dB between Tx and Rx chains.

Example Wireless Communication Scenario

Figure 1:
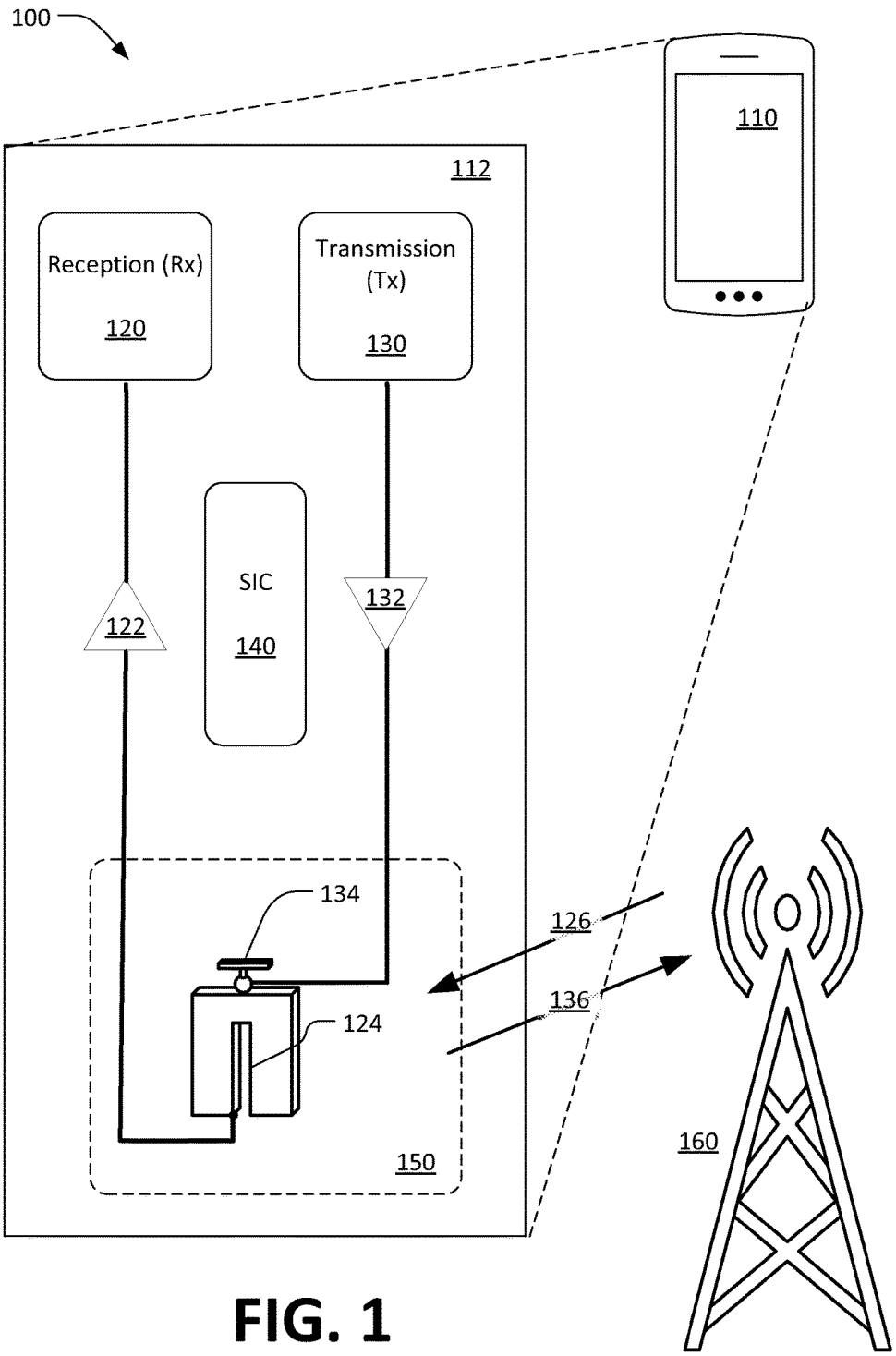
FIG. 1 illustrates an example scenario of a mobile-communications device in accordance with implementations described herein.

FIG. 1 shows an example wireless communication scenario 100 that utilizes an implementation of the antenna system, as described herein. As depicted, the example scenario 100 includes a mobile device 110 (such as a cellular phone, smartphone, tablet computer, etc.) as part of a wireless communication network, which is represented by a wireless tower 160. Even though the example scenario 100 shows the complementary antenna system in a mobile device 110, the antenna system can also be implemented on the wireless tower 160 or elsewhere in the wireless communication network.

Box 112 contains the relevant internal operating components of the wireless communication system of the mobile device 110. For the sake of illustration, the box 112 does not show all components of the mobile device 110 and all of the connections therebetween.

The depicted components include a reception subsystem and a transmission subsystem. Collectively, these subsystems may be called the wireless signal system. While this example wireless communication scenario 100 is described as having both a transmission and reception (Tx-Rx) subsystem. Other embodiments of the technology described herein may employ dual reception (Rx-Rx) systems or dual transmission (Tx-Tx) systems.

The reception subsystem includes reception circuitry 120, low-noise amplifier (LNA) 122, and reception antenna 124. The reception antenna 124 is shown receiving an incoming signal 126 from the wireless tower 160. The transmission subsystem includes transmission circuitry 130, a power amplifier (PA) 132, and a transmission antenna 134. The transmission antenna 134 is shown transmitting an outgoing signal 136 to the wireless tower 160.

Considered separately and independently, each of the transmission and reception subsystems (and their components) utilizes known techniques to accomplish their function. For example, receiving circuitry 120 employs known mechanisms (e.g., hardware, circuits, firmware, software (in cooperation with hardware), etc.) to accomplish reception of incoming wireless signals. LNA 122 is a known electronic amplifier used to amplify very weak signals (for example, signals captured by an antenna).

Note that each antenna is part of only one of the subsystems. Not both. That is, each antenna in the example wireless communication scenario 100 is dedicated to either the transmission subsystem or the reception subsystem. For other embodiments of the technology, each antenna is still only connected to one of the subsystems of a dual reception or dual transmission system.

With the example wireless communication scenario 100, the Tx and Rx subsystems are designed to be operated in in-band full-duplex mode. That is, each subsystem is configured to operate simultaneously (e.g., transmit or receive) within a common frequency band with the other subsystem. This situation occurs when the wireless signals system is in operation. Because of this, the reception subsystem is prone to self-interference from the transmitting subsystem. Of course, self-interference amelioration is one of the features of one or more of the implementation of the complementary antenna system, as described herein.

In other embodiments with a dual reception or dual transmission system, the self-interference can occur with the incoming/outgoing signals of the antennas interfere with each other. This situation occurs when the wireless signals system is in operation.

A self-interference cancellation (SIC) circuitry 140 is also shown as another internal component of the mobile device 110 in box 112. The SIC circuitry 140 employs known mechanisms (e.g., hardware, circuits, firmware, software (in cooperation with hardware), etc.) to accomplish a cancellation of self-interference caused by the large power differential between the mobile device's 110 own transmission and the signal of interest that originates from a distant node (e.g., cellular tower 160). The large power differential is simply because the self-interference signal has to travel much shorter distances compared to the signal of interest. As a result of the large power differential, the signal of interest is swamped by the self-interference most especially in the digital baseband due to the finite resolution of analog-to-digital conversion.

As depicted, a dashed box 150 encloses both the reception antenna 124 and transmission antenna 134. Collectively, these antennas represent the complementary antenna system, which is an example of the subject technology described herein. When referenced as the complementary antenna system 150 rather than the separate transmission and reception antennas (134, 124) respectively, the complementary antenna system 150 is not considered to be part of either of the transmission or reception subsystems.

As depicted, the antenna system 150 is a simplified illustration of one of the embodiments of the antenna systems described in more detail later. In particular, the embodiment depicted is shown in more detail in FIG. 3B and described below in its associated textual description.

As depicted, the reception antenna 124 is a slot antenna and the transmission antenna 134 is a monopole antenna. These antennas are bilaterally symmetrically co-located. That is, each antenna shares a common "antenna" plane with the other, and that plane symmetrically divides each antenna into mirrored halves.

The arrangement of the antenna system shown in FIG. 1 is one example embodiment. In other embodiments, the reception antenna 124 is the monopole antenna and the transmission antenna 134 is a slot antenna.

Figure 2:
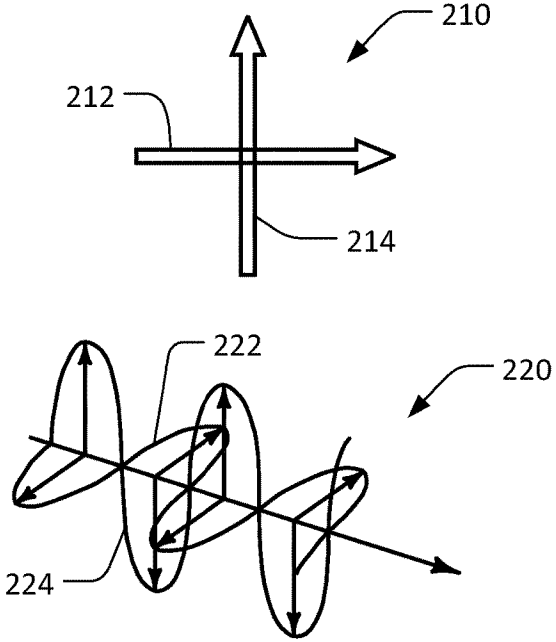
FIG. 2 illustrates simplified graphs depicting orthogonal linearly polarized radiation of a complementary pair of antennas in accordance with implementations described herein.

FIG. 2 illustrates the goal of a dual-polarized complementary antenna pair like that described herein. Electromagnetically, each of the antennas of the complementary antenna system 150 radiates in an orthogonal manner relative to each other. Ideally, each of the antennas radiates linearly in orthogonal (i.e., perpendicular) directions relative to each other.

This orthogonal relationship is shown by perpendicular arrows 212 and 214 of diagram 210. Diagram 220 shows the corresponding wave propagations of the pair of antennas. Wave propagation 222 corresponds to arrow 212 and wave propagation 224 corresponds to arrow 214.

The antenna pairs may be described as radiating with linear polarization substantially orthogonally from each other. Herein, the term "substantial" when applied to orthogonal (or the like) allows for plus/minus one degree from true or perfect orthogonal (i.e., perpendicular). Similarly, the term "nearly true" when applied to orthogonal (or the like) allows for plus/minus half a degree from true or perfect orthogonal.

As depicted in FIG. 1, the complementary antenna system 150 includes two linearly polarized antennas: separate transmission and reception antennas (134, 124). Generally, an antenna includes a transducer that converts radio frequency electric current to electromagnetic waves that are then radiated into free space. The electric field determines the polarization or orientation of the radio wave. In general, most antennas radiate either linear or circular polarization.

The antennas (134, 124) of the complementary antenna system 150 form dual orthogonal linearly polarized antennas. This means that, relative to each other or to an outside reference, one of the antennas is vertically polarized and the other is horizontally polarized.

Example Complementary Antenna Systems

Figure 3A:
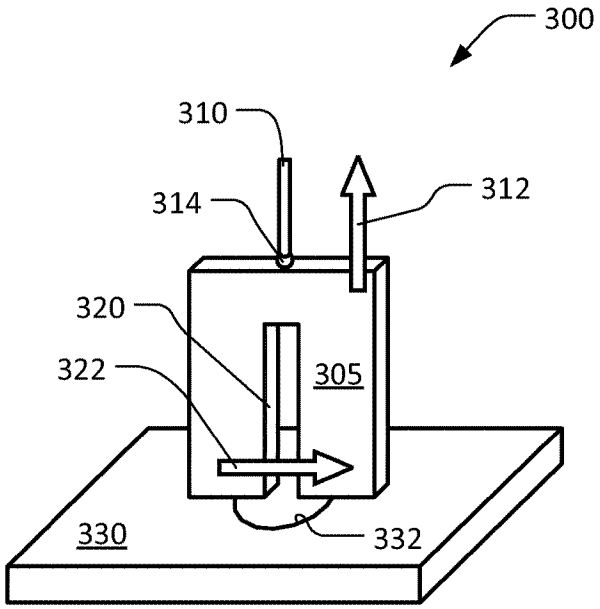
FIGS. 3A-C illustrate examples of complementary antenna systems in accordance with implementations described herein.
Figure 3C:
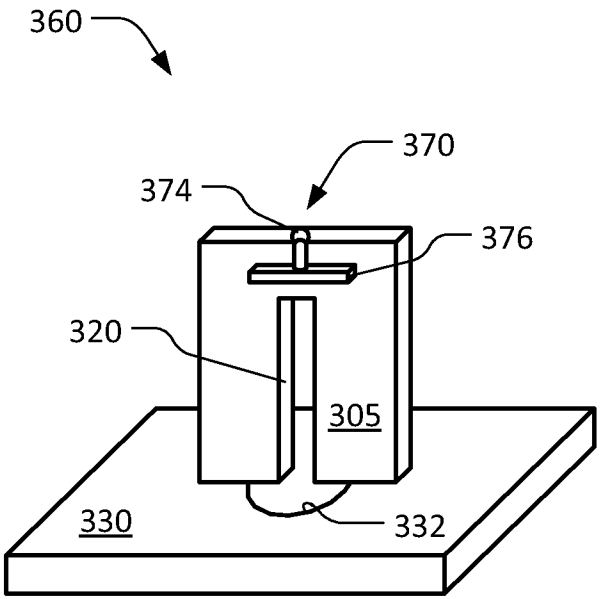
Figure 3B:
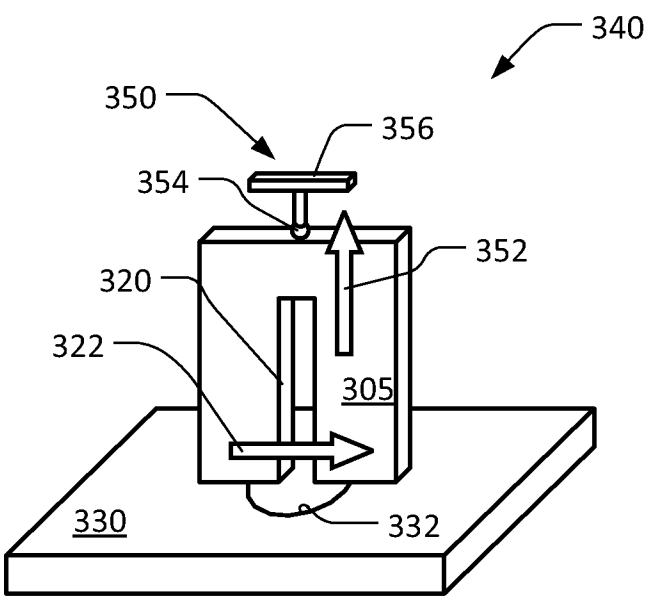

FIGS. 3A-C show several examples of complementary antenna systems in accordance with the technology described herein. For illustration purposes, the example antenna systems are shown in a simplified manner. For example, the substrate on which the antenna elements are attached is not shown. Similarly, most of the connecting links are not shown.

Each example complementary antenna system includes a pair of bilaterally symmetrical co-located and complimentary, but different types, of antennas. Namely, the pair includes monopole and slot antenna elements placed together. More particularly, the slot antenna is a half-slot antenna. The complementary antenna pair provides orthogonal antenna polarization, but in a bilaterally symmetrical co-located antenna structure.

FIG. 3A shows a simplified representation of an example complementary antenna system 300. The example antenna system 300 is an embodiment of the technology described herein. More particularly, this example complementary antenna system includes a monopole-and-slot pair 300 of antennas. With this, a monopole antenna 310 is physically co-located with a half-size slot antenna 320. The monopole antenna 310 and the slot antenna 320 electrically share a common ground plane 305. The common ground plane 305 is co-planar with the antennas. Thus, as depicted, the monopole antenna 310, slot antenna 320, and common ground plane exist in the same plane. That plane may be called the "antenna" plane and is defined, at least in part, by the planar nature of the ground plane 305.

Furthermore, the monopole antenna 310 is disposed in that antenna plane in a manner that symmetrically bisects the slot antenna 320. That is, both antennas share the antenna plane and are symmetrically physically co-located.

In general, a slot antenna consists of a metal surface (e.g., a flat plate) with a hole or slot therein. A half-slot antenna is a type of slot antenna with approximately half the length of a regular slot antenna. Despite the reduced length, the half-slot antenna offers similar performance as the regular slot antenna. Typically, the length of the half-slot antenna is about a quarter wavelength at the operating frequency instead of half-wavelength length as typically used with a regular slot antenna.

In general, a monopole antenna has a straight rod-shaped conductor, often mounted perpendicularly over some type of conductive surface, called a ground plane. The driving signal from the transmitter is applied (or for receiving antennas the output signal to the receiver is taken) between the lower end of the monopole and the ground plane. Typically, one end of the antenna feedline is operatively coupled to the lower end of the monopole while the other end is operatively coupled to the ground plane, which is often the Earth. This contrasts with a dipole antenna which consists of two identical rod conductors, with the signal from the transmitter applied between the two halves of the antenna.

The antennas operationally (e.g., electrically) share the common ground plane 305. The feedlines of each antenna are operatively coupled the ground plane 305. That is, the ground plane 305 grounds both antennas through their respective feedlines. The ground plane 305 is made of conductive material (e.g., copper). It is typically an embedded layer of a board.

The ground plane 305 may be thought of as extending vertically. If so, then the antennas (310, 320) also extend vertically with the ground plane 305. Thus, each of the antennas is coplanar with the ground plane 305.

A horizontal planar conductive element 330 is positioned below and orthogonal to the antennas (310, 320) and the ground plane 305. In some implementations, the conductive element 330 is ground. The conductive element 330 is electrically coupled to the common ground plane. Some implementations do not include or use the conductive element 330.

To enable the half-slot antenna operationality, the conductive element 330 has a hole 332 therethrough. The hole 332 (i.e., opening) is disposed below the slot of the slot antenna 320 and centered along a line of symmetry that bisects the slot antenna. The hole 332 is perpendicular to the ground plane 305. In one or more embodiments the hole 332 is circular or round. In other embodiments, the hole 332 is oval or elliptical in shape. While the hole 332 may be a literal air gap, it may also be filled with non-conductive material in some embodiments.

Herein, the terms horizontal and vertical refer to the relative relationship amongst the components of the antenna system and not literal or absolute meaning of such terms. That is, a horizontal component is considered to be substantially orthogonal to a vertical component. And vice versa.

The monopole antenna 310 has a feedline (not shown) at point 314, which is physically located below the two uppermost portion of the rod of the monopole antenna 310. The feedline operationally couples the monopole antenna 310 to the wireless signal system. For example, the feedline provides an active electrical connection with the transmission or reception subsystems.

While not shown in FIG. 3A, a feedline for the slot antenna 320 operationally couples to in the lower portion of the slot antenna to the wireless signals system in a similar manner. That portion is an area at or near arrow 322.

Arrow 312 indicates an example of linear polarization of the monopole antenna 310. Similarly, arrow 322 indicates an example of the linear polarization of the slot antenna 320. The arrows (312, 322) are orthogonal relative to each other. This represents the idealized orthogonal linear polarization of the antennas (310, 320).

In one or more embodiments, the size of the example complementary antenna system 300 is 0.7λ. For this, size is relative to the height from the ground plane to the farthest point of the antenna pair from that plane.

FIG. 3B shows a simplified representation of another example complementary antenna system 340. The example antenna system 340 is an embodiment of the technology described herein. This example complementary antenna system 340 has a complementary monopole-and-slot antenna pair similar to the example antenna system 300 described above. The difference between the two example antenna systems lies primarily with their monopole antennas.

The example complementary antenna system 340 has a T-shaped monopole antenna 350. The monopole antenna 350 is topped with a bilaterally symmetrical crossbar 356. The rod and crossbar 356 forms the T-shape of the monopole antenna 350. The monopole antenna 350 has a feedline (not shown) at point 354, which is physically located below the crossbar 356. The feedline operationally couples the monopole antenna 350 to the wireless signal system. For example, the feedline provides an active electrical connection with the transmission or reception subsystems.

Arrow 352 indicates an example of linear polarization of the monopole antenna 350. Similarly, arrow 322 indicates an example of the linear polarization of the slot antenna 320. The arrows (352, 322) are orthogonal relative to each other. This represents the idealized orthogonal linear polarization of the antennas (350, 320).

In one or more embodiments, the size of the example complementary antenna system 340 is 0.64λ.

FIG. 3C shows a simplified representation of still another example complementary antenna system 360. The example antenna system 360 is an embodiment of the technology described herein. This example complementary antenna system 360 has a complementary monopole-and-slot antenna pair similar to the example antenna system 340 described above. The difference between the two example antenna systems lies primarily with their monopole antennas.

Like the example antenna system 340 described above, the example complementary antenna system 360 has a T-shaped monopole antenna 370. However, the monopole antenna 370 of the example antenna system 360 is folded. Atop portion of the antenna 370 and its bilaterally symmetrical crossbar 376 is "folded" or bent so that the crossbar 376 is physically below its feedline (which is coupled to the antenna at point 374).

The feedline operationally couples the monopole antenna 370 to the wireless signal system. For example, the feedline provides an active electrical connection with the transmission or reception subsystems. In one or more embodiments, the size of the example complementary antenna system 360 is 0.6λ.

In terms of radiation performance, both antenna elements (e.g., monopole and half-slot antennas) of the example antenna systems achieve acceptable measured radiation efficiencies at ~80% or better. The monopole exhibits a two-lobe pattern in the vertical planes while the slot antenna exhibits a single lobe pattern. The monopole antenna radiation pattern shows a null at the z-axis.

The example antenna systems shown in FIGS. 3A-3C provide a very high isolation level (e.g., 60 dB or more) between antenna elements even though the antenna elements of each antenna are physically co-located because of the nature of the complementary antenna pairs with orthogonal polarizations. Some implementations achieve an isolation at 65 dB or higher. Therefore, electrical and magnetic fields from the antenna elements are decoupled, which gives the very high isolation level between the elements.

With one or more embodiments described herein, the antennas of the complementary antenna system are described as physically co-located. In one or more implementations, this means that the antennas are located within the boundaries of a common "real estate" (i.e., two-dimensional space,x-y directions, or plane) of the circuitry or circuit board of a mobile-communications device (e.g., the mobile device 110). In this way, the monopole antenna is physically located, at least partially, within the boundaries of one or more slots of the slot antenna.

Furthermore, with one or more embodiments described herein, the antennas of the complementary antenna system are described as bilateral symmetrically co-planar. That is, the antennas share the same plane and physically arranged or disposed together in a manner so that, if divided along a central axis (i.e., a line of symmetry) of the arrangement produces two equal halves. Each of the divided halves would be a mirror image of the other.

Further still, with one or more embodiments described above, the antennas of these systems share the same antenna plane as the common ground plane 305. In this way, the monopole antenna, slot antenna, and common ground plane are co-planar.

Feedlines and Dummy Lines

Figure 4B:
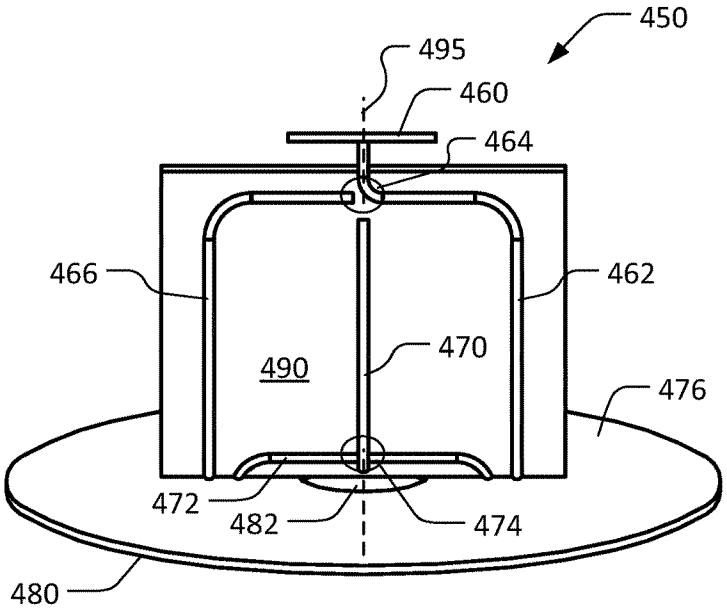
FIGS. 4A-B illustrate examples of complementary antenna systems in accordance with implementations described herein.
Figure 4A:
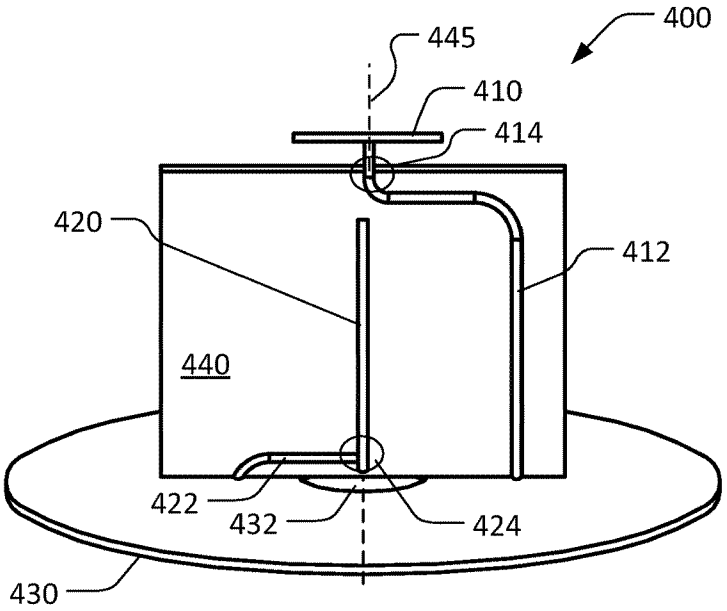

FIGS. 4A and 4B show two example antenna systems 400, 450 that each includes a complementary antenna system like example system 340 shown in FIG. 3B. The example antenna systems 400, 450 are embodiments of the technology described herein.

FIG. 4A shows the example antenna system 400. The system 400 includes a board 440 that contains a common ground plane (not depicted), which is typically a conductive layer in the board. The antenna system 400 also includes a T-shaped monopole antenna 410 and a bilateral-symmetrically and physically co-located slot antenna 420. These antennas are mutually co-planar. In addition, these antennas are co-planar with and are operatively coupled to the common ground plane in the board 440.

A planar conductive element 430 is located below and orthogonal to the antennas. In some implementations, the conductive element 430 is a ground. In some implementations, the conductive element 430 is electrically coupled to the common ground plane. In other implementations, the conductive element is not electrically coupled to the ground plane.

The conductive element 430 has a circular or oval-shaped hole 432 therein. The hole 432 (i.e., opening) centrally located under the co-located antennas. That is, the center of the hole 432 is located along a central axis 445 (i.e., line of symmetry) of the bilaterally symmetrical co-located co-planar antenna pairs. This hole 432 acts as part of the slot antenna 420 as it operates as a half-slot antenna.

Each antenna has a single feedline. In one or more embodiments the feedline may be a simple coaxial cable without any additional complicating components (e.g., a balun) as a dipole antenna often uses.

Feedline 412 operationally couples the monopole antenna 410 to the wireless signal system. For example, the feedline provides an active electrical connection with the transmission or reception subsystems. As depicted, feedline 412 connects to monopole antenna 410 at point 414 and also is connected to the common ground plane.

Similarly, feedline 422 operationally couples the slot antenna 420 to the wireless signal system. For example, the feedline provides an active electrical connection with the transmission or reception subsystems. As depicted, feedline 422 connects to slot antenna 420 at point 424 and also connects to the common ground plane.

Collectively, these two feedlines (412, 422) are called the feed structure for the example antenna system 400. The feed structure of the example antenna system 400 is asymmetric. That is, there is no mirrored structure (e.g., another feedline) on another side of the central axis 445 (i.e., line of symmetry) of the bilaterally symmetrical co-located co-planar antenna pairs. Because of this, there may be an imbalance of the surface currents and a breaking of the orthogonal relationship between the linearly polarized orthogonal unidirectional fields emanating from the antennas. This may inhibit isolation levels.

FIG. 4B shows the example antenna system 450 that is very similar to the example system 400 discussed above. However, this example antenna system 450 exhibits a greater isolation than the example system 400.

The system 450 includes a board 490 that contains a common ground plane (not depicted), which is typically a conductive layer in the board. The antenna system 450 also includes a T-shaped monopole antenna 460 and a bilateral-symmetrically and physically co-located slot antenna 470. These antennas are mutually co-planar. In addition, these antennas are co-planar with and are operatively coupled to the common ground plane in the board 490.

A planar conductive element 480 is positioned below and orthogonal to the antenna pairs. In some implementations, the conductive element 480 is ground. In some implementations, the conductive element 480 is electrically coupled to the common ground plane. In other implementations, the conductive element is not electrically coupled to the ground plane.

The conductive element 480 has a circular or oval-shaped hole 482 therein. The hole 482 centrally located under the co-located antennas. That is, the center of the hole 482 is located along a central axis 495 (i.e., line of symmetry) of the bilaterally symmetrical co-located co-planar antenna pairs. This hole 482 acts as part of the slot antenna 470 as it operates as a half-slot antenna. Each antenna has a single feedline. In one or more embodiments the feedline may be a simple coaxial cable without any additional complicating components (e.g., a balun) as a dipole antenna often uses.

Feedline 462 operationally couples the monopole antenna 460 to the wireless signal system. For example, the feedline provides an active electrical connection with the transmission or reception subsystems. As depicted, feedline 462 connects to monopole antenna 460 at point 464 and also is connects to the common ground plane.

Similarly, feedline 472 operationally couples the slot antenna 470 to the wireless signal system. For example, the feedline provides an active electrical connection with the transmission or reception subsystems. As depicted, feedline 472 connects to slot antenna 470 at point 474 and also connects to the common ground plane.

Unlike the example system 400, this example antenna system 450 has a "dummy" line for each feedline. In one or more embodiments, the dummy line may be a simple coaxial cable. In some of those embodiments, the dummy lines are shortened so that only the outer conductor carries the current.

A dummy line is a complementary symmetric replica of the feedline. That is, it is a structure that mirrors the feedline about the central axis 495 (i.e., line of symmetry) of the bilaterally symmetrical co-located co-planar antenna pairs . The dummy line is connected to the ground and the antenna, but it is not operatively coupled to a load. That is, the dummy line does not provide (i.e., is independent of) an active electrical connection with the transmission or reception subsystems.

A dummy line 466 connects the common ground plane to the monopole antenna 460 at point 464. Physically, the dummy line 466 is disposed and constructed in a manner that mirrors the feedline 462 about the central axis 495 of the bilaterally symmetrical co-located co-planar antenna pairs.

Similarly, a dummy line 476 connects the common ground plane to the slot antenna 470 at point 474. Physically, dummy line 476 is disposed and constructed in a manner that mirrors the feedline 472 about the line of symmetry 490 in the antenna plane (not shown) shared by both antennas.

Collectively, the two feedlines (462, 472) are called the feed structure for the example antenna system 450. Collectively, these two dummy lines (466, 476) are called the dummy line structure or the complementary symmetric replica structure of the example antenna system 450.

In some implementations, the complementary symmetric replica structure may be described as including a pair of dummy lines that are connected to the common ground. Each dummy line of the complementary symmetric replica structure is disposed along a symmetry line of the common antenna plane (i.e., the central axis 495) in a fashion that mirrors the feed structure. The dummy lines provide no operational coupling (i.e., electrical connection) between the antennas and the wireless signal subsystem.

The dummy line structure provides balance to the surface currents of the example antenna system 450. Indeed, with the dummy line structure, the example antenna system 450 may achieve a very high isolation level (e.g., greater than 60 dB). The conductive element 480 also helps achieve greater isolation levels. The conductive element 480 minimizes both return currents and near-field disturbance from the feedlines. Also, the conductive element 480 shapes the radiation pattern with higher directivity with wide angular coverage.

Oval-shaped T-Monopole Antenna Embodiment

Figures 5A, 5B, 5C:
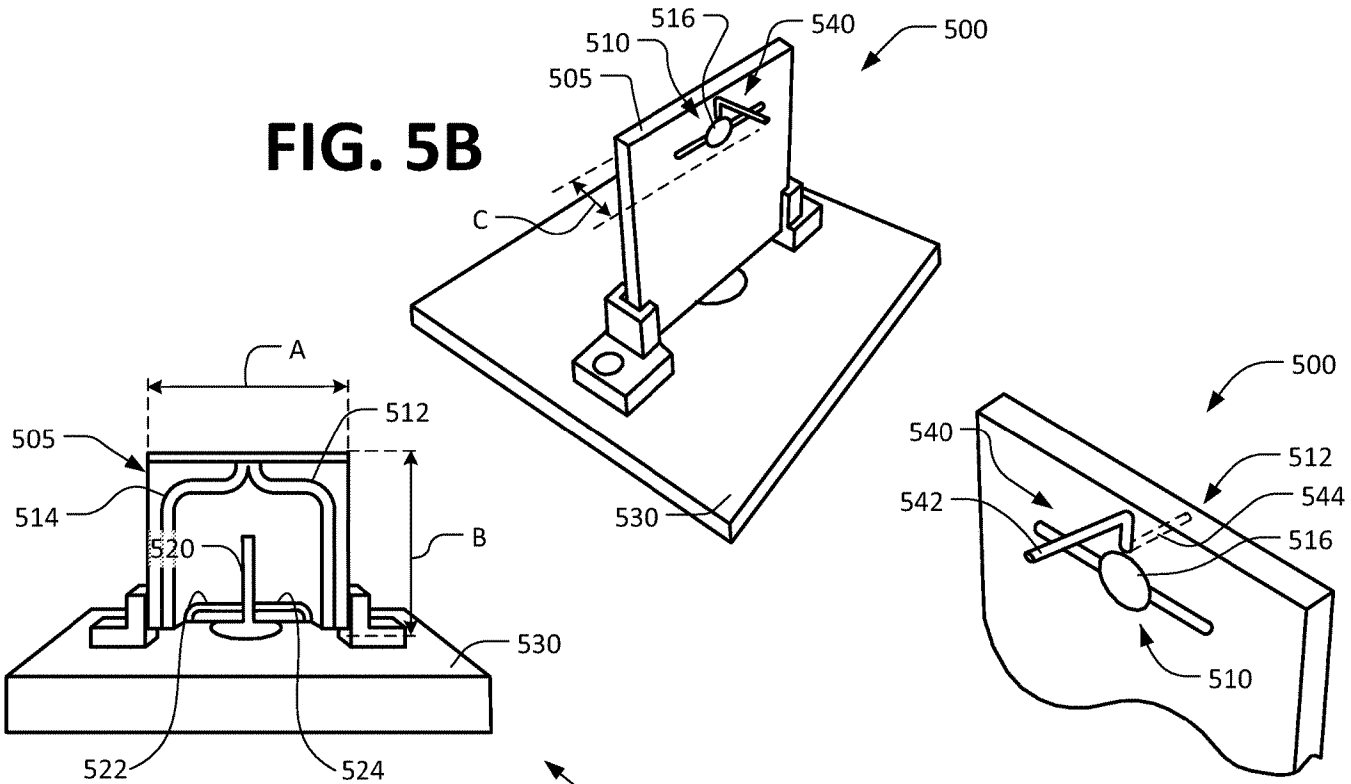
FIGS. 5A-5C illustrate various views of an example of a complementary antenna system in accordance with implementations described herein.

FIGS. 5A-5C show various views of an example antenna system 500. The example antenna system 500 is an embodiment of the technology described herein. The example antenna system 500 is a variation of the example antenna system 360.

The example antenna system 500 includes a two-sided board 505 (e.g., printed circuit board (PCB)) that is vertically mounted on a horizontal planar conductive element 530. The planar conductive element 530 is typically constructed from a conductive material such as copper or some other metal. FIG. 5A shows one side (i.e., nominally, the front side) of the board 505. FIG. 5B shows the other side (i.e., nominally, the back side) of the board 505. FIG. 5C shows an enlargement of a portion of the backside of the board 505.

As depicted in FIG. 5A, the front side of the board 505 shows a slot antenna 520, feed structure, and dummy structure. The feed structure includes a feedline 512 and feedline 522. The dummy structure includes dummy line 514 and dummy line 524. The feedline 512 and dummy line 514 are connected to a monopole antenna 510. The feedline 522 and dummy line 524 are connected to the slot antenna 520.

As depicted in FIG. 5B, the back side of the board 505 shows the monopole antenna 510. More particularly, the monopole antenna 510 is an oval-shaped T-monopole antenna that is folded and shortened to the ground. The monopole antenna 510 is a folded T-shaped antenna similar to that of the example antenna system 360. Unlike example system 360, the crossbar of the T shape is centered and symmetric oval 516. This is called an oval-shaped structure herein. Relative to the example antenna system 360, this arrangement improves the radiation pattern by removing the null at the bore-sight.

The oval-shaped structure is an example of one embodiment of a centered symmetrical closed-figure structure of the folded T-shaped monopole antenna suitable for use with the technology described herein. For other embodiments, the structure may be any symmetrical closed figure, such as a circle, square, rectangle, triangle, and other polygons. The shapes are closed, bilaterally symmetrical on the line of symmetry of the antenna pair, and offers impedance matching.

This example antenna system 500 utilizes a multi-layer PCB (i.e., board 505) with the folded oval T-monopole antenna 510 on one layer and the slot antenna 520 on another layer. The board 505 includes a common ground as part of one of the layers. In addition, the planar conductive element 530 compensates for the deep null at the normal orientation.

FIG. 5C shows an enlarged view upper portion of the back side of the board 505. This view shows the detail of the connection of the feedline 512 to the folded T-monopole antenna 510. This detail reveals a symmetric and orthogonal projection 540 of the folded T-monopole antenna 510. The orthogonal projection 540 is composed of conductive material, such as metal. The orthogonal projection 540 helps improve the overall radiation pattern of the monopole antenna 510 and improves isolation.

The orthogonal projection 540 projects from the back side of the board 505. More generally, the orthogonal projection 540 projects from the plane shared by the monopole antenna 510 and slot antenna 520. Thus, the orthogonal projection 540 is called orthogonal because some portion of the projection extends from the shared antenna plane.

As depicted, the orthogonal projection 540 of the example antenna system 500 includes an orthogonal arm 542 and shorting pin 544. The arm 542 is connected to the shorting pin 544, and the pin is connected to common ground via the dummy line 514. Although not depicted in FIG. 5C, the arm 542 is connected to the oval-shaped T-monopole antenna 510.

The arm 542 is a short straight metal wire that extends perpendicularly from the back of the board 505. In addition, the orthogonal projection is symmetrical along a line of symmetry of the antenna pair. With other implementations, the arm may be replaced by an arm projecting from the board at different angles or with other shapes (e.g., triangle) projecting from the board. However, those other implementations involve both a projection from the antenna plane and a projection from the line of symmetry of the antenna pair.

The example antenna system 500 has overall size of A×B×C (width×height×depth). With this system 500, the width is about 80 mm (millimeters), the height is about 70 mm, and the depth is about 13 mm. Of course, these dimensions differ with other implementations.

Additional and Alternative Implementation Details

While the implementations described herein reference use as part of a mobile device (such as a phone, cellular phone, smartphone, tablet computer, etc.), other implementations may be utilized in different types of mobile-communications devices, such as a base station, access point, repeater, backhaul, wireless tower, and the like. Herein, references to a mobile-communications device include all such devices that are commonly used in wireless communication network (e.g., WiFi, cellular, etc.) Also, herein, references to a portable mobile-communications device includes portable or mobile devices which interact or are part of that wireless communication network.

Herein, the components that are described as co-planar may be placed on opposite sides of a typical printed circuit board (PCB) and maintain their co-planar relationship. Thus, the term co-planar as used herein allows for some trivial or de minimis depth (i.e., z-direction) distance apart.

In some implementations, that trivial or de minimus distance is limited to the thickness of a typical PCB, which is 0.125 inches or less. In other implementations, that trivial or de minimus distance is limited 0.04 inches or less.

In contrast, the modifier "absolute" added to co-planar indicates that such components are one the same side of a board (e.g., PCB).

In the above description of example implementations, for purposes of explanation, specific numbers, materials configurations, and other details are set forth in order to better explain the present invention, as claimed. However, it will be apparent to one skilled in the art that the claimed invention may be practiced using different details than the example ones described herein. In other instances, well-known features are omitted or simplified to clarify the description of the example implementations.

The inventors intend the described example implementations to be primarily examples. The inventors do not intend these example implementations to limit the scope of the appended claims. Rather, the inventors have contemplated that the claimed invention might also be embodied and implemented in other ways, in conjunction with other present or future technologies.

Moreover, the word "example" is used herein to mean serving as an example, instance, or illustration. Any aspect or design described herein as "example" is not necessarily to be construed as preferred or advantageous over other aspects or designs. Rather, use of the word example is intended to present concepts and techniques in a concrete fashion. The term "techniques," for instance, may refer to one or more devices, apparatuses, systems, methods, articles of manufacture, and/or computer-readable instructions as indicated by the context described herein.

The following examples pertain to further embodiments:

Example 1 is an antenna system of a mobile-communications device comprising:

a linearly polarized monopole antenna operatively coupled to a wireless signal subsystem;

a linearly polarized slot antenna operatively coupled to the wireless signal subsystem;

a common ground plane that is shared by the monopole antenna and the slot antenna, wherein both antennas are co-planar and bilateral symmetrically co-located.

In Example 2: A system as recited in Example 1, wherein the common ground plane is co-planar with both the monopole antenna and the slot antenna.

In Example 3: A system as recited in Example 1, further comprising:

a planar conductive element being disposed orthogonally to both the monopole antenna and the slot antenna.

In Example 4: A system as recited in Example 1, further comprising a planar conductive element being disposed orthogonally to both the monopole antenna and the slot antenna, wherein the planar conductive element to form an opening below and in symmetrically disposed under a slot of the slot antenna In Example 5: A system as recited in Example 1, wherein the monopole antenna has a T-shape.

In Example 6: A system as recited in Example 1, wherein the monopole antenna has a folded T-shape.

In Example 7: A system as recited in Example 1, wherein the monopole antenna has a T-shape with a symmetrical closed-figure structure therein.

In Example 8: A system as recited in Example 1, wherein the monopole antenna has an oval T-shape, wherein the oval T-shape has a symmetrical oval structure therein.

In Example 9: A system as recited in Example 1, wherein the monopole antenna has an T-shape with a bilaterally symmetrical arm projecting from a plane shared by the antennas.

In Example 10: A system as recited in Example 1, wherein the monopole antenna has an T-shape with a bilaterally symmetrical closed-figure shape projecting from a plane shared by the antennas.

In Example 11: A system as recited in Example 1, wherein the slot antenna is a half-slot antenna.

In Example 12: A system as recited in Example 1 further comprising a feed structure that includes a pair of feed lines being connected to the common ground, each feed line of the feed structure operationally couples one of the antennas to the wireless signal subsystem.

In Example 13: A system as recited in Example 1 further comprising:

a feed structure that includes a pair of feed lines being connected to the common ground, each feed line of the feed structure operationally couples one of the antennas to the wireless signal subsystem;

a complementary symmetric replica structure that includes a pair of dummy lines being connected to the common ground, each dummy line of the complementary symmetric replica structure is disposed in a fashion that mirrors the feed structure, the dummy lines provide no operational coupling between the antennas and the wireless signal subsystem.

In Example 14: A system as recited in Example 1 further comprising a planar conductive element that is disposed below and orthogonal to a plane of the coplanar antennas, the planar conductive element operatively coupled to the monopole antenna to provide a reduction of null in a radiation pattern of the antennas along a direction of the plane of the coplanar antennas.

In Example 15: A system as recited in Example 1, wherein, when the mobile-communications device is operating, the monopole antenna and the slot antenna exhibit an isolation of at least about 60 dB.

In Example 16: A system as recited in Example 1, wherein the monopole antenna and the slot antenna are configured to radiate with linear polarization substantially orthogonal to one another when the mobile-communications device is operating.

In Example 17: A system as recited in Example 1, wherein each of the monopole antenna and the slot antenna is configured to radiate in a uni-directional pattern when the mobile-communications device is operating.

Example 18 is an antenna system comprising:

a monopole antenna operatively coupled to a wireless signal subsystem; and a slot antenna operatively coupled to the wireless signal subsystem, wherein both antennas are co-planar and bilateral symmetrically co-located.

In Example 19: A system as recited in Example 19, wherein the monopole antenna is linearly polarized and the slot antenna is linearly polarized.

In Example 20: A system as recited in Example 19, wherein the monopole antenna is linearly polarized and the slot antenna is linearly polarized, wherein the linear polarization of each antenna is substantially orthogonal to the other.

In Example 21: A system as recited in Example 19, wherein the monopole antenna is linearly polarized and the slot antenna is linearly polarized, wherein the linear polarization of each antenna is nearly truly orthogonal to the other.

In Example 22: A system as recited in Example 19 further comprising a common ground plane that is shared by the monopole antenna and the slot antenna.

In Example 23: A system as recited in Example 19 further comprising a common ground plane that is shared by the monopole antenna and the slot antenna, wherein the common ground plane is co-planar with both the monopole antenna and the slot antenna.

In Example 24: A system as recited in Example 19, wherein the monopole antenna has a T-shape.

In Example 25: A system as recited in Example 19, wherein the monopole antenna has a folded T-shape.

In Example 26: A system as recited in Example 19, wherein the monopole antenna has a T-shape with a symmetrical closed-figure structure therein.

In Example 27: A system as recited in Example 19, wherein the monopole antenna has an oval T-shape, wherein the oval T-shape has a symmetrical oval structure therein.

In Example 28: A system as recited in Example 19, wherein the monopole antenna has an T-shape with a bilaterally symmetrical arm projecting from a plane shared by the antennas.

In Example 29: A system as recited in Example 19, wherein the monopole antenna has an T-shape with a bilaterally symmetrical closed-figure shape projecting from a plane shared by the antennas.

In Example 30: A system as recited in Example 19 further comprising a feed structure that includes a pair of feed lines being connected to the common ground, each feed line of the feed structure operationally couples one of the antennas to the wireless signal subsystem.

In Example 31: A system as recited in Example 19 further comprising:

a feed structure that includes a pair of feed lines being connected to the common ground, each feed line of the feed structure operationally couples one of the antennas to the wireless signal subsystem;

a complementary symmetric replica structure that includes a pair of dummy lines being connected to the common ground, each dummy line of the complementary symmetric replica structure is disposed in a fashion that mirrors the feed structure, the dummy lines provide no operational coupling between the antennas and the wireless signal subsystem.

In Example 32: A system as recited in Example 19 further comprising a planar conductive element that is disposed below and orthogonal to a plane of the coplanar antennas, the planar conductive element operatively coupled to the monopole antenna to provide a reduction of null in a radiation pattern of the antennas along a direction of the plane of the coplanar antennas.

In Example 33: A system as recited in Example 19, wherein, when the mobile-communications device is operating, the monopole antenna and the slot antenna exhibit an isolation of at least about 60 dB.

In Example 34: A system as recited in Example 19, wherein the monopole antenna and the slot antenna are configured to radiate with linear polarization substantially orthogonal to one another when the mobile-communications device is operating.

In Example 35: A system as recited in c Example 19, wherein each of the monopole antenna and the slot antenna is configured to radiate in a uni-directional pattern when the mobile-communications device is operating.

Example 36 is a mobile-communications device comprising:

a monopole antenna operatively coupled to a wireless signal subsystem;

a slot antenna operatively coupled to the wireless signal subsystem;

a common ground plane that is shared by the monopole antenna and the slot antenna, wherein the common ground plane is co-planar with both the monopole antenna and the slot antenna, wherein both antennas are co-planar and bilateral symmetrically co-located.

In Example 37: A device as recited in Example 37, wherein the monopole antenna is linearly polarized and the slot antenna is linearly polarized.

In Example 38: A device as recited in Example 37, wherein the monopole antenna is linearly polarized and the slot antenna is linearly polarized, wherein the linear polarization of each antenna is substantially orthogonal to the other.

In Example 39: A device as recited in Example 37, wherein the monopole antenna is linearly polarized and the slot antenna is linearly polarized, wherein the linear polarization of each antenna is nearly truly orthogonal to the other.

In Example 40: A device as recited in Example 37, wherein the monopole antenna has a T-shape.

In Example 41: A device as recited in Example 37, wherein the monopole antenna has a folded T-shape.

In Example 42: A device as recited in Example 37, wherein the monopole antenna has a T-shape with a symmetrical closed-figure structure therein.

In Example 43: A device as recited in Example 37, wherein the monopole antenna has an oval T-shape, wherein the oval T-shape has a symmetrical oval structure therein.

In Example 44: A device as recited in Example 37, wherein the monopole antenna has an T-shape with a bilaterally symmetrical arm projecting from a plane shared by the antennas.

In Example 45: A device as recited in Example 37, wherein the monopole antenna has an T-shape with a bilaterally symmetrical closed-figure shape projecting from a plane shared by the antennas.

In Example 46: A device as recited in Example 37 further comprising a feed structure that includes a pair of feed lines being connected to the common ground, each feed line of the feed structure operationally couples one of the antennas to the wireless signal subsystem.

In Example 47: A device as recited in Example 37 further comprising:

a feed structure that includes a pair of feed lines being connected to the common ground, each feed line of the feed structure operationally couples one of the antennas to the wireless signal subsystem;

a complementary symmetric replica structure that includes a pair of dummy lines being connected to the common ground, each dummy line of the complementary symmetric replica structure is disposed in a fashion that mirrors the feed structure, the dummy lines provide no operational coupling between the antennas and the wireless signal subsystem.

In Example 48: A device as recited in Example 37 further comprising a planar conductive element that is disposed below and orthogonal to a plane of the coplanar antennas, the planar conductive element operatively coupled to the monopole antenna to provide a reduction of null in a radiation pattern of the antennas along a direction of the plane of the coplanar antennas.

In Example 49: A device as recited in Example 37, wherein, when the mobile-communications device is operating, the monopole antenna and the slot antenna exhibit an isolation of at least about 60 dB.

In Example 50: A device as recited in Example 37, wherein the monopole antenna and the slot antenna are configured to radiate with linear polarization substantially orthogonal to one another when the mobile-communications device is operating.

In Example 51: A device as recited in Example 37, wherein each of the monopole antenna and the slot antenna is configured to radiate in a uni-directional pattern when the mobile-communications device is operating.

What is claimed is:

1. An antenna system of a mobile-communications device comprising:

a monopole antenna coupled to a wireless signal subsystem;

a slot antenna coupled to the wireless signal subsystem, wherein the monopole antenna and the slot antenna are linearly polarized and co-planar;

an active feed structure including a first active feedline and a second active feedline, the first active feedline and the second active feedline each being coupled, respectively, to a common ground plane shared by the monopole antenna and the slot antenna, the first active feedline and the second active feedline coupling the monopole antenna and the slot antenna, respectively, to the wireless signal subsystem; and a dummy feed structure including a first dummy feedline and a second dummy feedline that is each coupled, respectively, to the common ground plane, the first dummy feedline being symmetric to the first active feedline about an axis of symmetry, and the second dummy feedline being symmetric to the second active feedline about the axis of symmetry.

2. The antenna system as recited in claim 1, wherein the common ground plane is co-planar with both the monopole antenna and the slot antenna.

3. The antenna system as recited in claim 1, further comprising:

a planar conductive element disposed orthogonal to both the monopole antenna and the slot antenna.

4. The antenna system as recited in claim 1, further comprising:

a planar conductive element disposed orthogonal to both the monopole antenna and the slot antenna, wherein the planar conductive element includes an opening disposed under a slot of the slot antenna.

5. The antenna system as recited in claim 1, wherein the monopole antenna has a T-shape.

6. The antenna system as recited in claim 1, wherein the monopole antenna has a folded T-shape.

7. The antenna system as recited in claim 1, wherein the monopole antenna has a T-shape with a symmetrical closed-figure structure therein.

8. The antenna system as recited in claim 1, wherein the monopole antenna has an oval T-shape, and wherein the oval T-shape has a symmetrical oval structure therein.

9. The antenna system as recited in claim 1, wherein the monopole antenna has an T-shape with an arm projecting from a plane occupied by the monopole antenna and the slot antenna.

10. The antenna system as recited in claim 1, wherein the monopole antenna has an T-shape with a closed-figure shape projecting from a plane occupied by the monopole antenna and the slot antenna.

11. The antenna system as recited in claim 1, wherein the slot antenna is a half-slot antenna.

12. The antenna system as recited in claim 1, wherein the first dummy feedline and the second dummy feedline provide no coupling between the monopole antenna and the slot antenna, respectively, and the wireless signal subsystem.

13. The antenna system as recited in claim 1, further comprising:

a planar conductive element is disposed below and orthogonal to a plane occupied by the monopole antenna and the slot antenna, the planar conductive element being coupled to the monopole antenna to compensate for a null in a radiation pattern associated with the monopole antenna and the slot antenna, the radiation pattern being along a direction of the plane occupied by the monopole antenna and the slot antenna.

14. The antenna system as recited in claim 1, wherein the monopole antenna and the slot antenna are configured to exhibit an isolation of at least 60 decibels (dB).

15. The antenna system as recited in claim 1, wherein the monopole antenna and the slot antenna are configured to radiate with respective linear polarizations that are substantially orthogonal to one another.

16. The antenna system as recited in claim 1, wherein each of the monopole antenna and the slot antenna is configured to radiate in a unidirectional pattern.

17. The antenna system of claim 1, wherein each of the monopole antenna and the slot antenna is bilaterally symmetric.

18. An antenna system comprising:

a monopole antenna coupled to a wireless signal subsystem;

a slot antenna coupled to the wireless signal subsystem, wherein the monopole antenna and the slot antenna are co-planar, an active feed structure including a first active feedline and a second active feedline, the first active feedline and the second active feedline each being coupled, respectively, to a common ground plane shared by the monopole antenna and the slot antenna, the first active feedline and the second active feedline coupling the monopole antenna and the slot antenna, respectively, to the wireless signal subsystem; and a dummy feed structure including a first dummy feedline and a second dummy feedline that is each coupled, respectively, to the common ground plane, the first dummy feedline being symmetric to the first active feedline about an axis of symmetry, and the second dummy feedline being symmetric to the second active feedline about the axis of symmetry.

19. The antenna system as recited in claim 18, wherein each of the monopole antenna and the slot antenna is linearly polarized.

20. The antenna system as recited in claim 18, wherein each of the monopole antenna and the slot antenna is linearly polarized, and wherein the linear polarization of each of the monopole antenna and the slot antenna is substantially orthogonal to one another.

21. The antenna system as recited in claim 18, wherein each of the monopole antenna and the slot antenna is linearly polarized, and wherein the linear polarization of each of the monopole antenna and the slot antenna is nearly truly orthogonal to one another.

22. The antenna system as recited in claim 18, wherein the common ground plane is co-planar with both the monopole antenna and the slot antenna.

23. The antenna system as recited in claim 18, wherein the monopole antenna has a T-shape.

24. The antenna system as recited in claim 18, wherein the monopole antenna has a folded T-shape.

25. The antenna system as recited in claim 18, wherein the monopole antenna has a T-shape with a symmetrical closed-figure structure therein.

26. The antenna system as recited in claim 18, wherein the monopole antenna has an oval T-shape, wherein the oval T-shape has a symmetrical oval structure therein.

27. The antenna system as recited in claim 18, wherein the monopole antenna has an T-shape with an arm projecting from a plane occupied by the monopole antenna and the slot antenna.

28. The antenna system as recited in claim 18, wherein the monopole antenna has an T-shape with a closed-figure shape projecting from a plane occupied by the monopole antenna and the slot antenna.

29. The antenna system as recited in claim 18 wherein the first dummy feedline and the second dummy feedline provide no coupling between the monopole antenna and the slot antenna, respectively, and the wireless signal subsystem.

30. The antenna system as recited in claim 18, further comprising:

a planar conductive element disposed below and orthogonal to a plane occupied by the monopole antenna and the slot antenna, the planar conductive element being coupled to the monopole antenna to compensate for a null in a radiation pattern associated with the monopole antenna and the slot antenna, the radiation pattern being along a direction of the plane occupied by the monopole antenna and the slot antenna.

31. The antenna system as recited in claim 18, wherein, the monopole antenna and the slot antenna are configured to exhibit an isolation of at least about 60 dB.

32. The antenna system as recited in claim 18, wherein the monopole antenna and the slot antenna are configured to radiate with respective linear polarizations that are substantially orthogonal to one another.

33. The antenna system as recited in claim 18, wherein each of the monopole antenna and the slot antenna is configured to radiate in a unidirectional pattern.

34. The antenna system of claim 18, wherein each of the monopole antenna and the slot antenna is bilaterally symmetric.

35. A mobile-communications device comprising:

a monopole antenna coupled to a wireless signal subsystem;

a slot antenna coupled to the wireless signal subsystem;

a common ground plane that is shared by the monopole antenna and the slot antenna, wherein the common ground plane is co-planar with both the monopole antenna and the slot antenna, wherein each of the monopole antenna and the slot antenna are co-planar;

an active feed structure including a first active feedline and a second active feedline, the first active feedline and the second active feedline each being coupled, respectively, to the common ground plane, the first active feedline and the second active feedline coupling the monopole antenna and the slot antenna, respectively, to the wireless signal subsystem; and a dummy feed structure including a first dummy feedline and a second dummy feedline that is each coupled, respectively, to the common ground plane, the first dummy feedline being symmetric to the first active feedline about an axis of symmetry, and the second dummy feedline being symmetric to the second active feedline about the axis of symmetry.

36. The mobile-communications device as recited in claim 35, wherein each of the monopole antenna and the slot antenna is linearly polarized.

37. The mobile-communications device as recited in claim 35, wherein each of the monopole antenna and the slot antenna is linearly polarized, and wherein the linear polarization of each the of the monopole antenna and the slot antenna is substantially orthogonal to one another.

38. The mobile-communications device as recited in claim 35, wherein each of the monopole antenna and the slot antenna is linearly polarized, and wherein the linear polarization of each the monopole antenna and the slot antenna is nearly truly orthogonal to one another.

39. The mobile-communications device as recited in claim 35, wherein the monopole antenna has a T-shape.

40. The mobile-communications device as recited in claim 35, wherein the monopole antenna has a folded T-shape.

41. The mobile-communications device as recited in claim 35, wherein the monopole antenna has a T-shape with a symmetrical closed-figure structure therein.

42. The mobile-communications device as recited in claim 35, wherein the monopole antenna has an oval T-shape, and wherein the oval T-shape has a symmetrical oval structure therein.

43. The mobile-communications device as recited in claim 35, wherein the monopole antenna has an T-shape with an arm projecting from a plane occupied by the monopole antenna and the slot antenna.

44. The mobile-communications device as recited in claim 35, wherein the monopole antenna has an T-shape with a closed-figure shape projecting from a plane occupied by the monopole antenna and the slot antenna.

45. The mobile-communications device as recited in claim 35, wherein the first dummy feedline and the second dummy feedline provide no coupling between the monopole antenna and the slot antenna, respectively, and the wireless signal subsystem.

46. The mobile-communications device as recited in claim 35, further comprising:

a planar conductive element that is disposed below and orthogonal to a occupied by the monopole antenna and the slot antenna, the planar conductive element operatively coupled to the monopole antenna to provide a reduction of null in a radiation pattern of the antennas along a direction of the plane of the coplanar antennas.

47. The mobile-communications device as recited in claim 35, wherein the monopole antenna and the slot antenna are configured to exhibit an isolation of at least about 60 dB.

48. The mobile-communications device as recited in claim 35, wherein the monopole antenna and the slot antenna are configured to radiate with respective linear polarizations that are substantially orthogonal to one another.

49. The mobile-communications device as recited in claim 35, wherein each of the monopole antenna and the slot antenna is configured to radiate in a unidirectional pattern.

50. The mobile-communications device of claim 35, wherein each of the monopole antenna and the slot antenna is bilaterally symmetric.

* * * * *